US011760594B2

(12) United States Patent
Ogasawara

(10) Patent No.: US 11,760,594 B2
(45) Date of Patent: Sep. 19, 2023

(54) DOCUMENT FEEDER AND IMAGE FORMING APPARATUS

(71) Applicant: SHARP KABUSHIKI KAISHA, Sakai (JP)

(72) Inventor: Hironori Ogasawara, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 29 days.

(21) Appl. No.: 17/459,952

(22) Filed: Aug. 27, 2021

(65) Prior Publication Data

US 2022/0063940 A1 Mar. 3, 2022

(30) Foreign Application Priority Data

Sep. 2, 2020 (JP) ..... 2020-147592

(51) Int. Cl.
*B65H 3/06* (2006.01)
*B65H 3/66* (2006.01)
*G03G 15/00* (2006.01)

(52) U.S. Cl.
CPC ..... *B65H 3/66* (2013.01); *B65H 3/0669* (2013.01); *G03G 15/6529* (2013.01)

(58) Field of Classification Search
CPC combination set(s) only.
See application file for complete search history.

(56) References Cited

U.S. PATENT DOCUMENTS 4,523,754 A * 6/1985 Hisajima ..... B65H 3/44 165/47
4,901,117 A * 2/1990 Derrick ..... B65H 3/44 271/118
6,089,561 A * 7/2000 Marshall ..... B65H 7/02 271/111
6,805,509 B2 * 10/2004 Ahn ..... G03G 15/6502 400/709
7,427,060 B2 * 9/2008 Taniyama ..... B65H 5/06 271/274
7,997,579 B2 * 8/2011 Furuyama ..... G03G 15/6529 271/264
8,322,715 B2 * 12/2012 Mandel ..... B65H 5/36 271/272
8,556,258 B2 * 10/2013 Mizubata ..... B26F 1/0092 271/220
2013/0320611 A1 * 12/2013 Kubo ..... B65H 3/0615 271/114

FOREIGN PATENT DOCUMENTS

JP 2013-060277 A 4/2013

* cited by examiner

*Primary Examiner* — Thomas A Morrison
(74) *Attorney, Agent, or Firm* — ScienBiziP, P.C.

(57) ABSTRACT

A document feeder includes a device body, and an opening and closing cover which is provided to be openable and closable with respect to the device body, and including a paper feed roller and a paper feed roller drive shaft on the device body. The document feeder includes a guide member, which is mounted rotatably to the paper feed roller drive shaft on an outer side of the paper feed roller in a roller axis direction thereof. The guide member guides a document being conveyed, in a state where the opening and closing cover is closed, by being opposed to the paper feed roller drive shaft in a predetermined orientation.

8 Claims, 7 Drawing Sheets

DOCUMENT FEEDER AND IMAGE FORMING APPARATUS

CROSS-REFERENCE TO RELATED APPLICATION

The present application claims priority from Japanese Application JP 2020-147592, the content to which is hereby incorporated by reference into this application.

BACKGROUND OF THE INVENTION

1. Field of the Invention

The present invention relates to a document feeder and an image forming apparatus.

2. Description of the Background Art

In an image forming apparatus such as a multifunction peripheral, a document reader is provided. Further, the document reader is usually used together with a document feeder. The document feeder separates and feeds documents one at a time from a bundle of documents placed on a document tray by means of a pickup roller and a paper feed roller, and conveys the fed document to be discharged to a paper discharge tray by way of an image reading position.

Also, the document feeder includes an opening and closing cover so that jam processing can be performed by opening a conveyance path when a document conveyance jam has occurred. As for the paper feed roller, one configuration is to mount the paper feed roller to the opening and closing cover, and another configuration is to mount the same to a device body of the document feeder. Employing the configuration in which the paper feed roller is mounted to the device body brings about the advantage of being able to simplify a driving power transmission mechanism from a driving source such as a motor to the paper feed roller.

SUMMARY OF THE INVENTION

When the paper feed roller is mounted to the device body, a drive shaft which drives the paper feed roller is also to be mounted on the device body. However, at a time of document conveyance, a front edge of the document may get caught on the drive shaft, and cause a conveyance jam.

Incidentally, Japanese Unexamined Patent Application Publication No. 2013-60277 discloses, although this disclosure pertains to a paper feeding device, not a document feeder, a configuration in which an auxiliary roller for preventing an impact from being externally applied to a paper feed roller is mounted on a paper feed roller drive shaft. However, even if the auxiliary roller of Japanese Unexamined Patent Application Publication No. 2013-60277 is applied to a document feeder, it is not possible to prevent a front edge of a document from being caught in a recess of an opening and closing cover.

One aspect of the present invention has been conceived in view of the above problem, and it is an object of the present invention to provide a document feeder and an image forming apparatus capable of preventing a conveyance jam caused by a document being caught on a drive shaft which drives a paper feed roller.

In order to solve the problem as described above, a document feeder, which is a first aspect of the present invention, pertains to a document feeder including a device body, and an opening and closing cover which is provided to be openable and closable with respect to the device body, and also including a paper feed roller and a paper feed roller drive shaft on the device body, in which the document feeder is characterized by including a guide member, which is mounted rotatably to the paper feed roller drive shaft on the outer side of the paper feed roller in a roller axis direction thereof, and guides a document being conveyed, in a state where the opening and closing cover is closed, by being opposed to the paper feed roller drive shaft in a predetermined orientation.

According to above the configuration, since the guide member is rotatably mounted to the paper feed roller drive shaft, the guide member can be made to function as a conveyance guide by having the guide member opposed to the paper feed roller drive shaft, in the state where the opening and closing cover is closed. By this feature, at the time of document conveyance, it is possible to prevent a front edge of the document from being caught on the paper feed roller drive shaft and causing a conveyance jam.

Further, the document feeder described above may be configured such that a recess is provided at a position opposed to the paper feed roller and the paper feed roller drive shaft on a lower surface of the opening and closing cover.

Further, the document feeder described above may be configured such that the guide member includes a conveyance guide surface formed as a flat surface.

According to the above configuration, at the time of document conveyance, it is possible to smoothly guide the front edge of the document by means of an upper conveyance guide, which is constituted of the lower surface of the opening and closing cover, and the conveyance guide surface of the guide member.

Further, the document feeder described above may be configured such that the guide member, which is mounted to the paper feed roller drive shaft, is maintained in the predetermined orientation in which the conveyance guide surface faces downward by the weight of the guide member itself.

Further, the document feeder described above may be configured such that the guide member is provided on both sides of the paper feed roller with respect to the paper feed roller drive shaft.

Further, the document feeder described above may be configured such that the guide member is provided with an inclined surface on an upstream side in a document conveyance direction with respect to the conveyance guide surface, and the inclined surface has an inclination that is raised from a downstream side toward the upstream side in a state where the guide member is set to the predetermined orientation.

According to the configuration described above, by virtue of providing the inclined surface on the guide member, it is possible to prevent a front edge of a document from being caught in a gap (a gap between the conveyance guide surface and the lower surface of the opening and closing cover) on the upstream side of the guide member, and more reliably prevent a conveyance jam of the document.

Further, the document feeder described above may be configured such that, in a state where the opening and closing cover is closed, and the guide member is set to the predetermined orientation, a step so formed that the conveyance guide surface is positioned on an upper side is provided between the lower surface of the opening and closing cover that is located on the upstream side of the conveyance guide surface and the conveyance guide surface, and a step so formed that the conveyance guide surface is positioned on a lower side is provided between the lower surface of the opening and closing cover that is located on the downstream side of the conveyance guide surface and the conveyance guide surface.

According to the configuration described above, the upper conveyance guide, which is constituted of the lower surface of the opening and closing cover and the conveyance guide surface of the guide member, is formed in a stepwise configuration having steps. By virtue of the above steps, it is possible to prevent a front edge of a document from being caught in the gaps on the upstream side and the downstream side of the guide member, and more reliably prevent a conveyance jam of the document.

Further, the document feeder described above may be configured such that the conveyance guide surface is arranged with inclination to be raised from the downstream side toward the upstream side in the document conveyance direction, in a state where the guide member is set to the predetermined orientation.

According to the configuration described above, by virtue of the inclined arrangement of the conveyance guide surface, steps are created between the conveyance guide surface and the lower surface of the opening and closing cover. By virtue of the above steps, it is possible to prevent a front edge of a document from being caught in the gaps on the upstream side and the downstream side of the guide member, and more reliably prevent a conveyance jam of the document.

Further, the document feeder described above may be configured such that an outer end portion of the guide member in the roller axis direction is extended exteriorly relative to each of both ends of a maximum size document in a document width direction.

Furthermore, in order to solve the problem as described above, an image forming apparatus, which is a second aspect of the present invention, is characterized by including the document feeder described above.

In the document feeder and the image forming apparatus according to one aspect of the present invention, the guide member is rotatably mounted to the paper feed roller drive shaft. Thus, at the time of document conveyance, the front edge of the document can be prevented from being caught on the drive shaft which drives the paper feed roller, which, as a result, brings about the advantage of being able to prevent a conveyance jam from occurring.

DETAILED DESCRIPTION OF THE INVENTION

Embodiment 1

Figure 1:
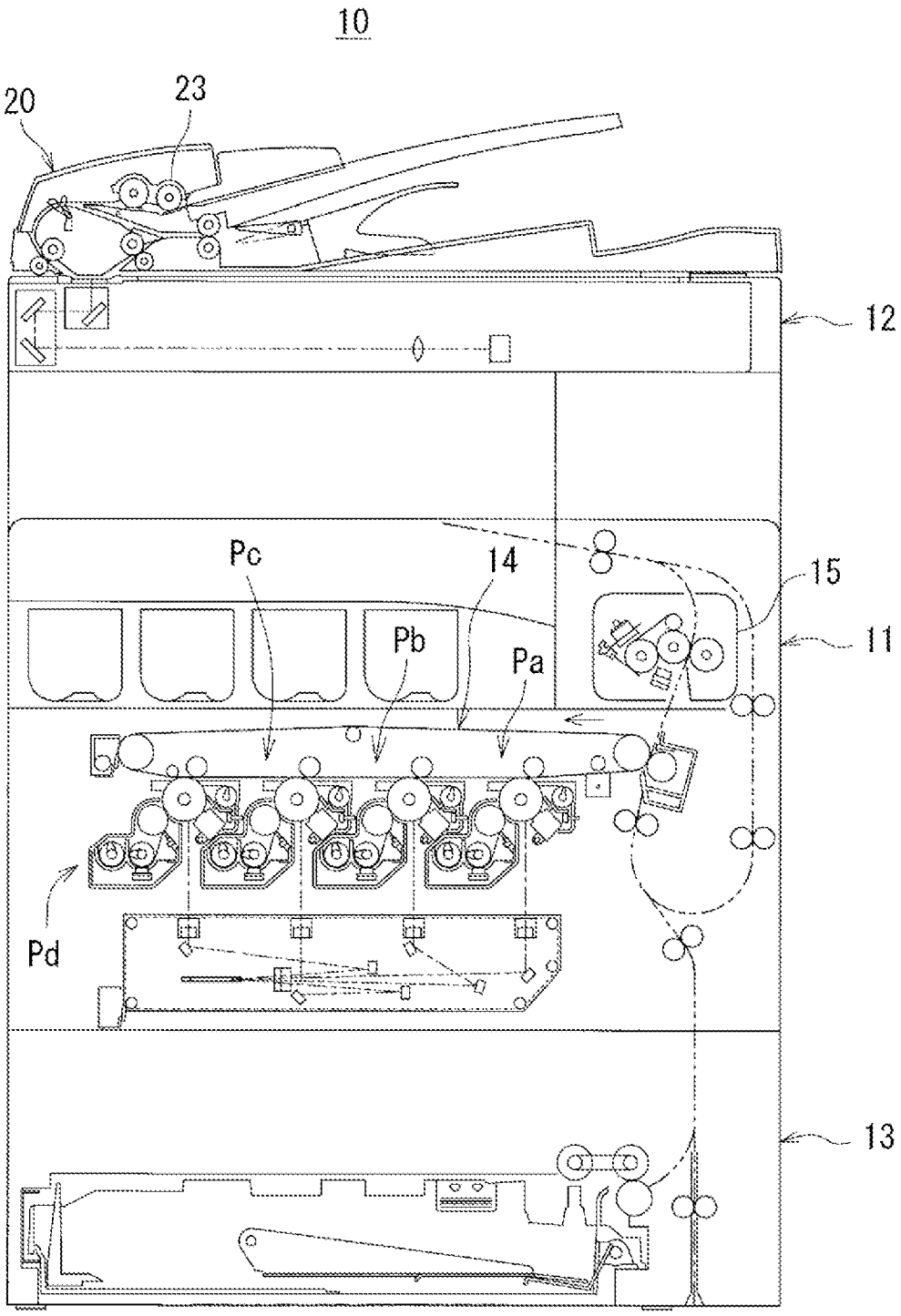
FIG. 1 shows one embodiment of the present invention, and is a schematic cross-sectional view of an image forming apparatus.

In the following, embodiments of the present invention will be described in detail with reference to the drawings. FIG. 1 is a schematic configuration diagram showing an example of an image forming apparatus 10 to which one aspect of the present invention is applied. While the image forming apparatus 10 illustrated in FIG. 1 is a color image forming apparatus including a plurality of process units, the present invention is not limited to the above, and can also be applied to a monochrome image forming apparatus including a single process unit.

As illustrated in FIG. 1, the image forming apparatus 10 is comprised of a main body part 11, a document reader 12, a document feeder 20, and a paper feeding device 13. The main body part 11 includes therein an image former for printing images on sheets of recording paper. The document reader 12 is arranged above the main body part 11, and reads a document when making a copy of the document. In an automatic reading mode, the document feeder 20 sequentially conveys documents placed on a document set tray toward a document placement table of the document reader 12. The paper feeding device 13 stocks sheets of recording paper, and feeds the recording paper to the main body part 11 when an image is to be formed.

Image data handled in the image forming apparatus 10 is that which corresponds to a color image using respective colors of black (K), cyan (C), magenta (M), and yellow (Y), or that which corresponds to a monochrome image using a single color (for example, black). Consequently, the image forming apparatus 10 includes four process units Pa to Pd corresponding to black, cyan, magenta, and yellow. Each of the process units Pa to Pd forms a toner image corresponding to the image data by using electrophotographic technology.

The toner images formed by the respective process units Pa to Pd are sequentially transferred to an intermediate transfer belt 14, and overlap one another. In this way, a colored toner image is formed on the intermediate transfer belt 14. The colored toner image on the intermediate transfer belt 14 is transferred onto the recording paper, and a fusing device 15 heats and pressurizes the recording paper to fuse the colored toner image on the recording paper.

Figure 2:
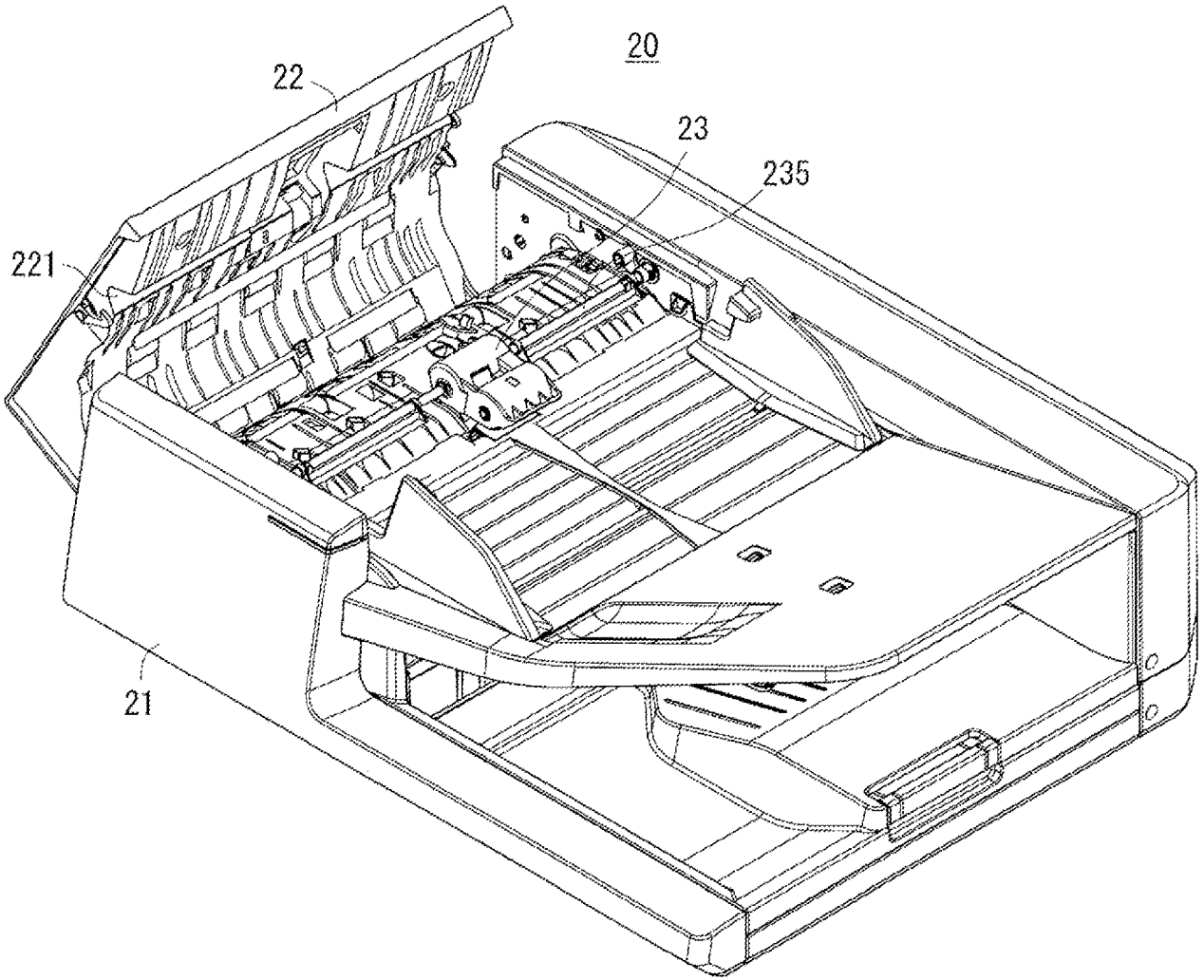
FIG. 2 illustrates the outer appearance of a document feeder, and is a perspective view showing the state in which an opening and closing cover is open.

In the following, characteristic structures of the document feeder 20 according to Embodiment 1 of the present invention will be described. FIG. 2 illustrates the outer appearance of the document feeder 20, and is a perspective view showing the state in which an opening and closing cover 22 is open.

The document feeder 20 includes the opening and closing cover 22 which is provided to be openable and closable with respect to a device body 21, and when a document conveyance jam occurs, a conveyance path is opened by opening the opening and closing cover 22, whereby jam processing can be performed. Also, in the document feeder 20, a document paper feed unit 23 including a paper feed roller 232 and a pickup roller 233 to be described later is provided not on the opening and closing cover 22, but on the device body 21 side. As the document paper feed unit 23 is provided on the device body 21 side, the document paper feed unit 23 is not transferred even when the opening and closing cover 22 is opened, and a driving power transmission mechanism from a driving source such as a motor to the paper feed roller 232 and the pickup roller 233 can be simplified.

A lower surface of the opening and closing cover 22 serves as an upper paper guide (a conveyance guide) for a document to be conveyed when the document feeder 20 is in use (i.e., in a state where the opening and closing cover 22 is closed). A lower paper guide in the above state is formed on an upper surface of the device body 21. Further, a recess 221, which serves as a clearance for the document paper feed unit 23 (in particular, the paper feed roller 232 and a drive shaft 235 to be described later) in a state where the opening and closing cover 22 is closed, is provided on the lower surface of the opening and closing cover 22. More specifically, the recess 221 is formed such that it is dented toward an upper side thereof at a position opposed to the paper feed roller 232 and the drive shaft (paper feed roller drive shaft) 235, in a state where the opening and closing cover 22 is closed, and is open at a lower side thereof.

Figure 3:
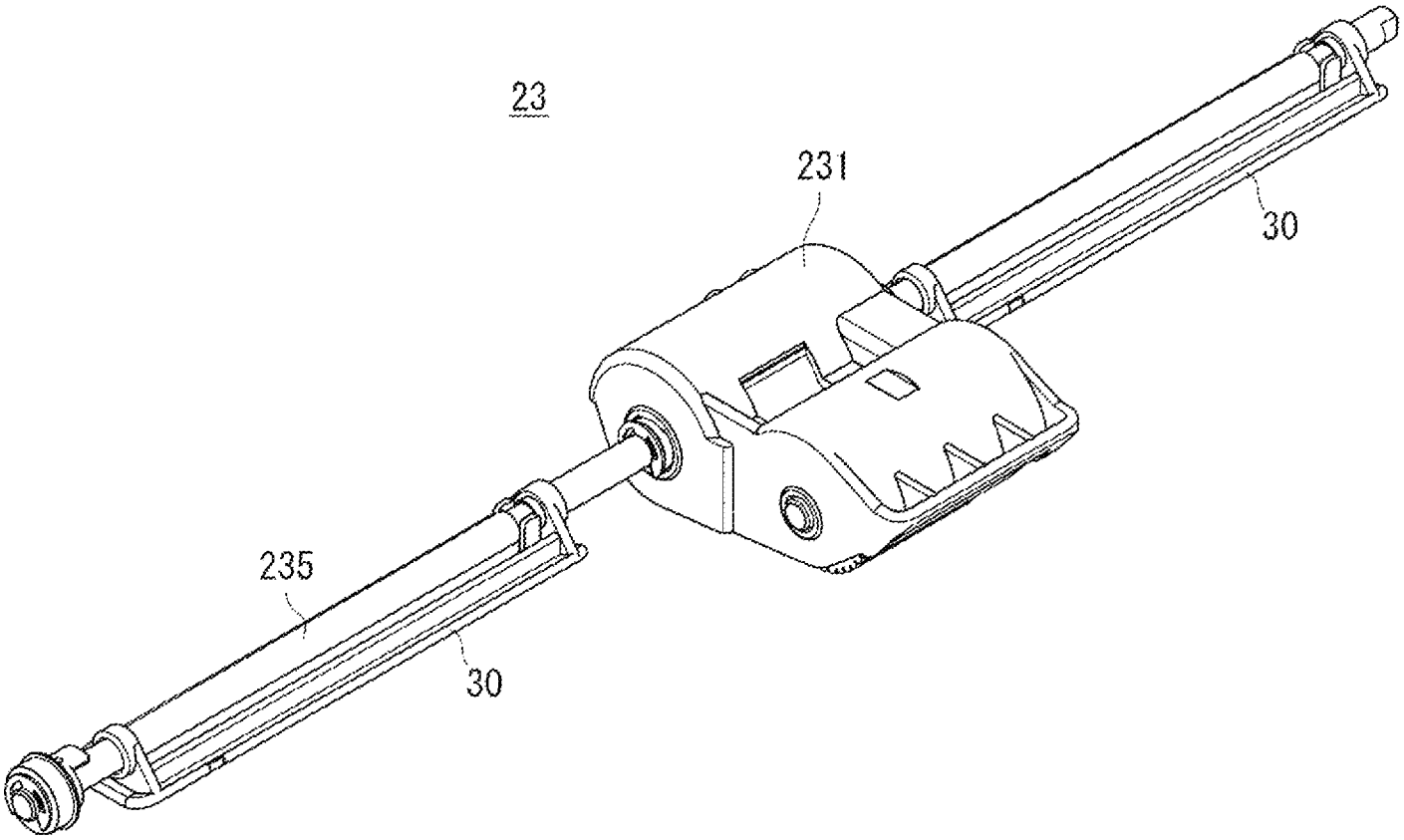
FIG. 3 is a perspective view of a document paper feed unit as seen from diagonally above.
Figure 4:
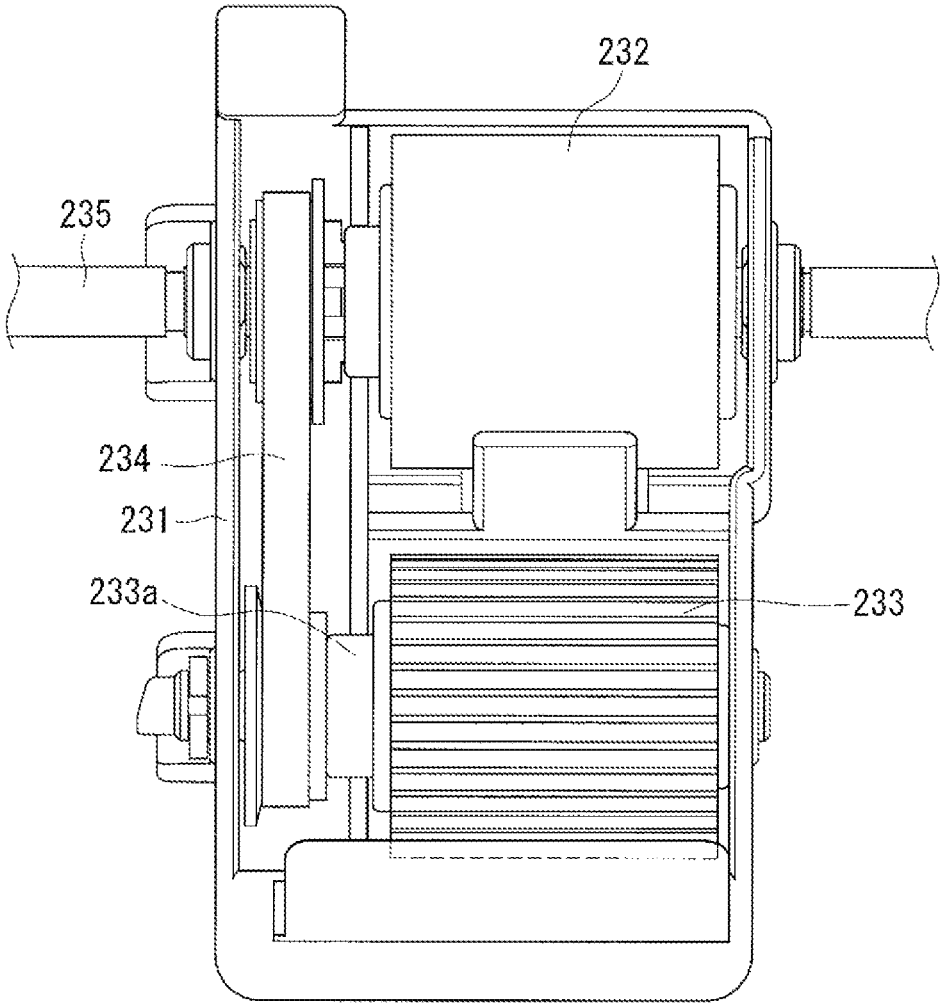
FIG. 4 is a bottom view of a housing portion of the document paper feed unit.

Next, a configuration of the document paper feed unit 23 will be described. FIG. 3 is a perspective view of the document paper feed unit 23 as seen from diagonally above. FIG. 4 is a bottom view of a housing portion of the document paper feed unit 23.

As illustrated in FIGS. 3 and 4, the document paper feed unit 23 includes a housing 231, the paper feed roller 232, the pickup roller 233, a transmission belt 234, the drive shaft 235, and a guide member 30. The housing 231 is open at a lower side thereof, and includes a space therein. The paper feed roller 232, the pickup roller 233, and the transmission belt 234 are accommodated inside the space. As for the paper feed roller 232 and the pickup roller 233, lower parts thereof protrude downwardly relative to the housing 231 so that the aforementioned rollers can contact a document passing thereunder. In the document paper feed unit 23, the pickup roller 233 is arranged on an upstream side in a document conveyance direction relative to the paper feed roller 232.

The paper feed roller 232 is mounted on the drive shaft 235. The drive shaft 235 extends to the outer side of the housing 231, and rotates as it receives driving power from a driving source (such as a motor) not shown. In the pickup roller 233, a rotary shaft 233*a* of the pickup roller 233 itself is pivotably supported on the housing 231. The transmission belt 234 is stretched around the drive shaft 235 and the rotary shaft 233*a*. Consequently, when the drive shaft 235 is rotated, not only the paper feed roller 232 but also the pickup roller 233 is rotated via the transmission belt 234.

Figure 5:
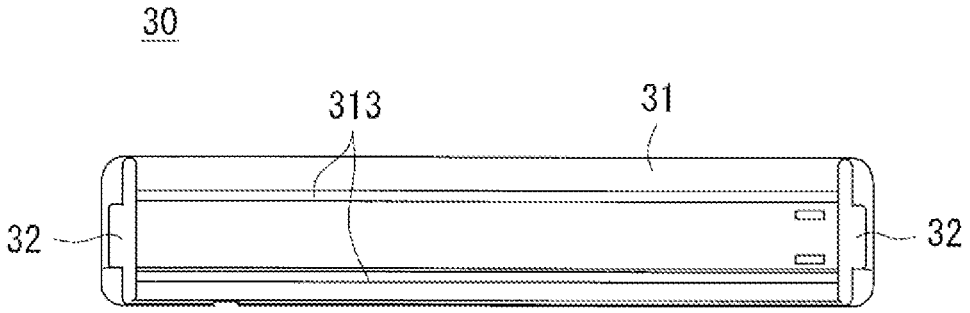
FIG. 5 is a top view of a guide member.
Figure 6:
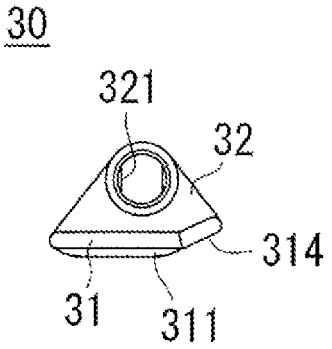
FIG. 6 is a side view of the guide member.
Figure 7:
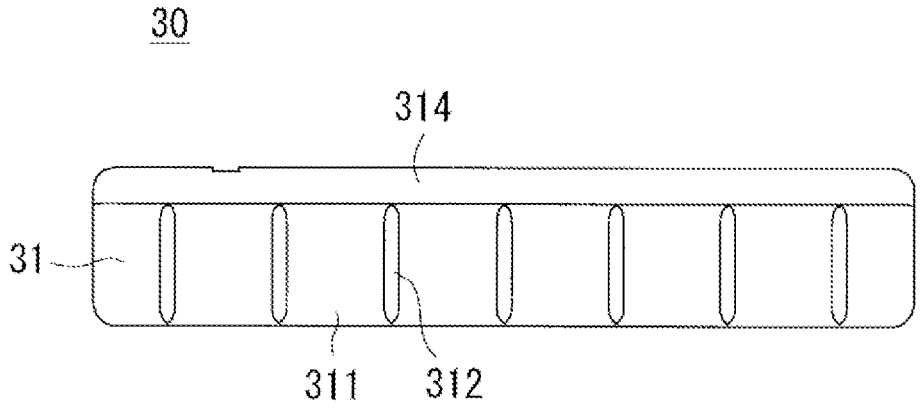
FIG. 7 is a bottom view of the guide member.

The guide member 30 is mounted to the drive shaft 235, on the outer side of the housing 231 (i.e., on the outer side in a roller axis direction of the paper feed roller 232), or more specifically, the guide member 30 is provided on each of both sides of the housing 231. FIG. 5 is a top view of the guide member 30. FIG. 6 is a side view of the guide member 30. FIG. 7 is a bottom view of the guide member 30.

In the guide member 30, a direction along the drive shaft 235 (i.e., a document width direction) corresponds to a longitudinal direction, and the guide member 30 includes a paper guide portion 31 along the longitudinal direction, and a shaft mounting portion 32 provided at both ends of the paper guide portion 31. The paper guide portion 31 is formed in the shape of an elongated substantially rectangular plate, and a flat surface which serves as a paper guide surface 311 is formed on one main surface. The shaft mounting portion 32 is provided to be disposed upright from an end portion of the paper guide portion 31 to the opposite side of the paper guide surface 311. Also, the shaft mounting portion 32 is formed in a substantially triangular shape, the paper guide portion 31 is connected to the shaft mounting portion 32 along one side of the triangle, and a through-hole 321 for passing the drive shaft 235 is provided near the opposite angle of the side connected to the paper guide portion 31.

The paper guide surface 311 may be provided with a plurality of guide ribs 312 along the document conveyance direction (lateral direction). Also, a reinforcing rib 313 may be provided along the document width direction on a side which is opposite to the paper guide surface 311 in the paper guide portion 31. The guide members 30 which are each provided on both sides of the housing 231 may be those that use members of the same shape for both of them.

The guide member 30 is mounted to the document paper feed unit 23 by passing the drive shaft 235 through the through-hole 321 of the shaft mounting portion 32. In doing so, the guide member 30 is rotatably mounted to the drive shaft 235, and is maintained by the weight of the guide member 30 itself in a predetermined orientation to function as a paper guide. Specifically, the guide member 30 is set at a weight balance of bringing the paper guide surface 311 to always face downward by the weight of the guide member 30 itself, and the state as described is maintained even at a time of document conveyance (i.e., when the drive shaft 235 is rotated) in the document feeder 20.

Here, when the drive shaft 235 is rotated, there may be a case where the guide member 30 is rotated together in relation to the drive shaft 235 due to friction produced between an outer peripheral surface of the drive shaft 235 and an inner wall surface of the through-hole 321 of the guide member 30. However, also in this case, rotation of the guide member 30 is restricted as the guide member 30 comes into contact with a wall surface of the recess 221. Therefore, the guide member 30 is not greatly displaced by being rotated together with the drive shaft 235.

Further, although the guide member 30 is rotatably mounted to the drive shaft 235, preferably, movement along the axial direction should be restricted. For this reason, a positioning groove having approximately the same width as the thickness of the shaft mounting portion 32 may be provided at a predetermined position of the drive shaft 235, and the shaft mounting portion 32 may be arranged within the positioning groove.

Figure 8:
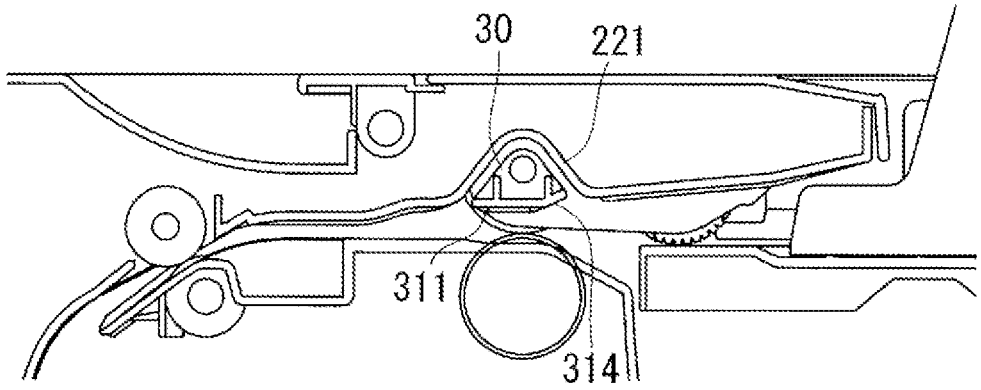
FIG. 8 is a partial cross-sectional view of the vicinity of the guide member along a document conveyance direction in the document feeder according to Embodiments 1 and 2.

In the document feeder 20 according to Embodiment 1 of the present invention, the guide member 30 is provided at the document paper feed unit 23. By virtue of this feature, in a state where the opening and closing cover 22 is closed, the guide member 30 is opposed to the drive shaft 235 in an opening portion of the recess 221 existing on the both sides of the housing 231, and the opening portion of the recess 221 can be covered with the guide member 30, as shown in FIG. 8. That is, the lower surface of the opening and closing cover 22 and the paper guide surface 311 of the guide member 30 form a substantially continuous upper paper guide. Consequently, at the time of document conveyance, a front edge of a document is smoothly guided by the upper paper guide constituted of the lower surface of the opening and closing cover 22, and the paper guide surface 311 of the guide member 30, and it is possible to prevent the front edge of the document from being caught on the drive shaft 235 or the recess 221 and causing a conveyance jam.

Preferably, the guide member 30 should have a dimension of enabling guidance for a document of the maximum size (e.g., A3 size [297 mm]) among the regular sizes that can be conveyed in the document feeder 20. That is, preferably, outer end portions of the respective guide members 30 should be extended exteriorly relative to both ends of the document of the maximum size in the document width direction. Also, preferably, the guide member 30 should have a dimension of enabling guidance for a document of the smallest size (e.g., half letter size [5.5 inches]) among the regular sizes whose size is greater than a widthwise dimension of the paper feed roller 232 (or the housing 231). That is, preferably, inner end portions of the respective guide members 30 should be extended interiorly relative to both ends of the document of the minimum size in the document width direction. As for a regular size (e.g., business card size) whose size is smaller than the widthwise dimension of the paper feed roller 232 (or the housing 231), a front edge of a document does not get caught on the drive shaft 235 or the recess 221 even if the document is not guided by the guide member 30.

Embodiment 2

The document feeder 20 described in Embodiment 1 is configured such that the guide member 30 covers the opening portion of the recess 221 in the state where the opening and closing cover 22 is closed, and the lower surface of the opening and closing cover 22 and the paper guide surface 311 of the guide member 30 form a substantially continuous upper paper guide. However, even with the above configuration, it is not possible to form an upper paper guide in which the lower surface of the opening and closing cover 22 and the paper guide surface 311 of the guide member 30 are completely continuous. In other words, at an upstream side and a downstream side of the guide member 30 in the document conveyance direction, a gap, though small, is created between the paper guide surface 311 and the lower surface of the opening and closing cover 22. Accordingly, if a front edge of a document being conveyed is curled upward, for example, the front edge of the curled document may get caught in the gap.

For this reason, the document feeder 20 should preferably have a configuration which can prevent the front edge of the document from being caught in the gap between the guide member 30 and the opening and closing cover 22, thereby more reliably preventing a conveyance jam of the document.

As such a configuration, in the document feeder 20, as illustrated in FIGS. 6 to 8, the guide member 30 is provided with an inclined surface 314 on an upstream side of the paper guide surface 311. The inclined surface 314 has an inclination that is raised from the downstream side toward the upstream side in a state where the guide member 30 is set to a predetermined orientation by the weight of the guide member 30 itself. In this way, by virtue of providing the inclined surface 314 on the guide member 30, it is possible to prevent a front edge of a document from being caught in the gap on the upstream side of the guide member 30.

Embodiment 3

A document feeder 20 according to Embodiment 3 of the present invention represents another modification which can prevent a front edge of a document from being caught in a gap between a guide member 30 and an opening and closing cover 22, thereby more reliably preventing a conveyance jam of the document.

Figure 9:
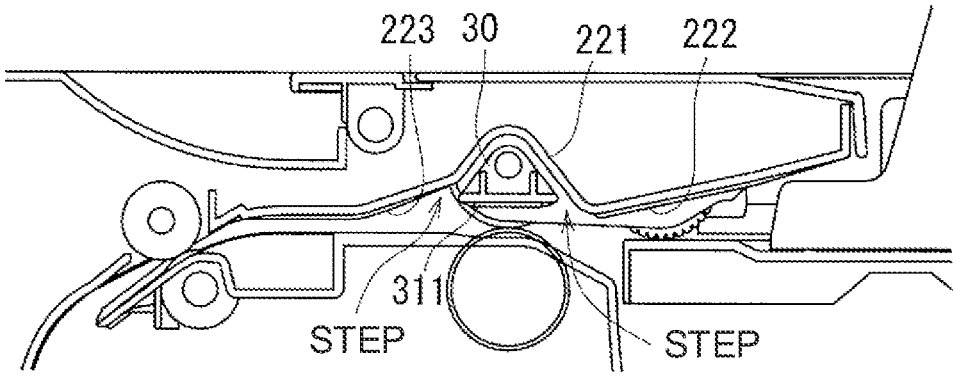
FIG. 9 is a partial cross-sectional view of the vicinity of a guide member along a document conveyance direction in a document feeder according to Embodiment 3.

As illustrated in FIG. 9, in the document feeder 20 of Embodiment 3 of the present invention, an upper paper guide, which is constituted of lower surfaces 222 and 223 of the opening and closing cover 22 and a paper guide surface 311 of the guide member 30, is formed in a stepwise configuration. That is, a step so formed that the paper guide surface 311 is positioned on the upper side is provided between the lower surface 222 of the opening and closing cover 22 that is located on the upstream side of the paper guide surface 311 and the paper guide surface 311. By virtue of the above step, it is possible to prevent a front edge of a document from being caught in the gap on the upstream side of the guide member 30.

Also, a step so formed that the paper guide surface 311 is positioned on the lower side is provided between the lower surface 223 of the opening and closing cover 22 that is located on the downstream side of the paper guide surface 311 and the paper guide surface 311. By virtue of the above step, it is possible to prevent the front edge of the document from being caught in the gap on the downstream side of the guide member 30.

Embodiment 4

A document feeder 20 according to Embodiment 4 of the present invention represents yet another modification which can prevent a front edge of a document from being caught in a gap between a guide member 30 and an opening and closing cover 22, thereby more reliably preventing a conveyance jam of the document.

Figure 10:
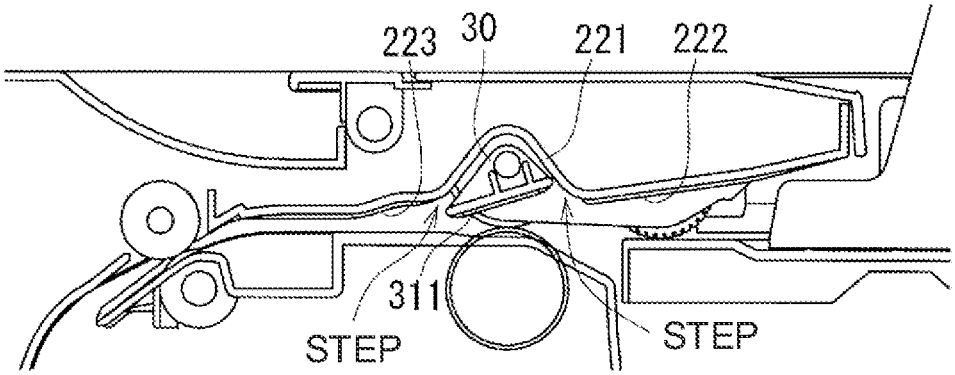
FIG. 10 is a partial cross-sectional view of the vicinity of a guide member along a document conveyance direction in a document feeder according to Embodiment 4.

As illustrated in FIG. 10, in the document feeder 20 of Embodiment 4 of the present invention, an upper paper guide, which is constituted of lower surfaces 222 and 223 of the opening and closing cover 22 and a paper guide surface 311 of the guide member 30, is configured such that the paper guide surface 311 is inclined relative to the lower surfaces 222 and 223 of the opening and closing cover 22.

The paper guide surface 311 is arranged with inclination to be raised from the downstream side toward the upstream side in a state where the guide member 30 is set to a predetermined orientation by the weight of the guide member 30 itself. Consequently, in the gap on the upstream side of the paper guide surface 311, a step, which is of a kind that the paper guide surface 311 is positioned on the upper side, is created between a downstream-side end portion of the lower surface 222 of the opening and closing cover 22 and an upstream-side end portion of the paper guide surface 311. Also, in the gap on the downstream side of the paper guide surface 311, a step, which is of a kind that the paper guide surface 311 is positioned on the lower side, is created between an upstream-side end portion of the lower surface 223 of the opening and closing cover 22 and a downstream-side end portion of the paper guide surface 311. By virtue of the above steps, it is possible to prevent the front edge of the document from being caught in the gaps on the upstream side and the downstream side of the guide member 30. Note that the guide member 30 having the paper guide surface 311 inclined in this manner can be easily designed by adjusting the weight balance of the guide member 30.

The embodiments disclosed herein are merely exemplary in all respects, and do not constitute grounds for restrictive interpretation. Accordingly, the technical scope of the present invention is not to be interpreted in terms of the embodiments described above alone, but is defined on the basis of the recitations of the claims. Further, all changes which come within the meaning and scope of the claims and their equivalents are to be embraced herein.

What is claimed is:

1. A document feeder comprising a device body, and an opening and closing cover, which is provided to be openable and closable with respect to the device body, and including a paper feed roller and a paper feed roller drive shaft on the device body, the document feeder further comprising a guide member, which is mounted rotatably to the paper feed roller drive shaft on an outer side of the paper feed roller in a roller axis direction thereof, and guides a document being conveyed, in a state where the opening and closing cover is closed, by being opposed to the paper feed roller drive shaft in a predetermined orientation, wherein:

the guide member includes a conveyance guide surface formed as a flat surface, and in a state where the opening and closing cover is closed, and the guide member is set to the predetermined orientation, in a gap on an upstream side of the conveyance guide surface, a step, at which an upstream-side end portion of the conveyance guide surface is positioned on a side higher in elevation compared to a downstream-side end portion of a lower surface of the opening and closing cover, exists between the upstream-side end portion of the conveyance guide surface and the downstream-side end portion of the lower surface of the opening and closing cover, and in a gap on a downstream side of the conveyance guide surface, another step, at which a downstream-side end portion of the conveyance guide surface is positioned on a side lower in elevation compared to an upstream-side end portion of the lower surface of the opening and closing cover, exists between the upstream-side end portion of the lower surface of the opening and closing cover and the downstream-side end portion of the conveyance guide surface.

2. The document feeder according to claim 1, wherein a recess is provided at a position opposed to the paper feed roller and the paper feed roller drive shaft on a lower surface of the opening and closing cover.

3. The document feeder according to claim 1, wherein the guide member, which is mounted to the paper feed roller drive shaft, is maintained in the predetermined orientation in which the conveyance guide surface faces downward by a weight of the guide member.

4. The document feeder according to claim 1, wherein the guide member is provided on both sides of the paper feed roller with respect to the paper feed roller drive shaft.

5. The document feeder according to claim 1, wherein:

the guide member is provided with an inclined surface on an upstream side in a document conveyance direction with respect to the conveyance guide surface; and the inclined surface has an inclination that is raised from a downstream side toward the upstream side in a state where the guide member is set to the predetermined orientation.

6. The document feeder according to claim 1, wherein the conveyance guide surface is arranged with inclination to be raised from a downstream side toward an upstream side in a document conveyance direction, in a state where the guide member is set to the predetermined orientation.

7. The document feeder according to claim 1, wherein an outer end portion of the guide member in the roller axis direction is extended exteriorly relative to each of both ends of a maximum size document in a document width direction.

8. An image forming apparatus comprising the document feeder according to claim 1.

* * * * *